United States Patent [19]

Falgout, Sr. et al.

[11] Patent Number: 4,618,010

[45] Date of Patent: Oct. 21, 1986

[54] HOLE OPENER

[75] Inventors: Thomas E. Falgout, Sr., Lafayette; John W. Hester, Houma, both of La.

[73] Assignee: Team Engineering and Manufacturing, Inc., Youngsville, La.

[21] Appl. No.: 830,181

[22] Filed: Feb. 18, 1986

[51] Int. Cl.[4] ..... E21B 7/28; E21B 10/26; E21B 10/56; E21B 10/60

[52] U.S. Cl. ..... 175/329; 175/325; 175/385; 175/410; 175/422 R

[58] Field of Search ..... 175/325, 324, 323, 329, 175/385, 391, 393, 406, 410, 411, 424

[56] References Cited

U.S. PATENT DOCUMENTS

| | | | |
|---|---|---|---|
| 2,009,742 | 7/1935 | Mitchell | 175/329 |
| 3,180,439 | 4/1965 | Deely | 175/325 X |
| 3,575,247 | 4/1971 | Feenstra | 175/329 |
| 3,820,611 | 6/1974 | King | 175/325 X |
| 4,081,203 | 3/1978 | Fuller | 175/325 X |
| 4,273,201 | 6/1981 | Garrett | 175/325 X |
| 4,403,668 | 9/1983 | Ramsey | 175/325 |
| 4,467,879 | 8/1984 | Burge | 175/325 |
| 4,540,055 | 9/1985 | Drummond et al. | 175/324 X |
| 4,550,790 | 11/1985 | Link | 175/329 |

*Primary Examiner*—Stephen J. Novosad
*Attorney, Agent, or Firm*—John D. Jeter

[57] ABSTRACT

A hole opener for use on drill strings in well bore enlargement operations featuring a bore follower extension and a stabilized cutter with poly crystalline diamond compact cutter elements arrayed in a plurality of cutting spiral patterns. Fluid jets are directed toward the cutter arrays and also directed to sweep the opener cut formation in groove regions between the cutter arrays. A hard metal chip covering is on the follower extension to open pilot hole bridges, assisted by a nose jet. Blade form vortex barriers are situated at the confluence of the cutter cleaning and formation sweeping fluid jets. The follower extension is tapered to increase the upward velocity of fluid rising past the extension.

11 Claims, 4 Drawing Figures

HOLE OPENER

This invention pertains to downhole drilling tools for use on drill strings to enlarge the diameter of an existing pilot hole or well.

RELATED ART

Hole openers in current use commonly employ rolling cutters to enlarge an existing hole. Poly-crystalline diamond compact cutters are currently used on hole drilling bits, or drill heads, but are not known to be used on hole openers. Poly-crystalline diamond compacts are coin sized and shaped elements marketed to the general drilling related industries for use as cutters. There are several mounting systems in use but the cutters are usually brazed to a mounting post which, in turn, is usually pressed into holes in a drill head form. An Alternate process places the cutters in position in a powder metal compact and the whole is later infiltrated with braze metal to produce a final composite drilling head.

BACKGROUND OF THE INVENTION

In conventional earth bore hole drilling apparatus, the drill head is axially stabilized by the load required to destroy rock. Blade type cutting structures require very little axial load to bite into the formations drilled and axial control or stabilization is almost absent. Blade type bits cutting soft formations encounter few problems because torque does not increase drastically as advance per turn increases. Similarly, shallow drilling with blade type cutters encounters few problems because short suspended drill strings are, axially, quite rigid and advance per turn can be controlled by the upper end of the drill string. On long drill strings, there is a lower axial sping rate in the drill string and more stick-slip problems arise and axial stability decreases.

Hole openers are subject to damagae from reduction of axial stability. It is well known that diamond bits used to ream holes experience wide fluctuations of drilling torque and bits so used are often damaged in the gage region. On drilling turbines, diamond bits used to ream holes cause severe speed fluctuations and considerable damage. Any attempt to use poly-crystalline diamond cutters on hole openers must be structured with the damage history in view. Blade type cutting devices fitted with poly-crystalline compacts still behave as a blade type cutter as previously described. The use of the existing, or pilot, hole for radial stabilization assumes confidence on the remaining integrity of the hole, devoid of bridges, fractures and loosened inclusions. At best, only radial stability may be taken for granted.

OBJECTS

It is therefore an object of this invention to provide hole opening apparatus utilizing poly-crystalline diamond cutting structures, provided with axial and radial stability.

It is another object of this invention to provide hole opening apparatus with separate fluid jets to clean the cutting structures and the exposed cut face of the formation.

It is yet another object of this invention to provide a hole opener preceded and guided into an existing hole by a follower extension of tapered diameter to cause an increase in the velocity of fluid rising past the extension.

It is still another object of this invention to provide a hole opener that has barrier blades in the region of confluence of cutter cleaning and formation cleaning fluid jets.

It is yet a further object of this invention to provide a hole opener, using poly-crystalline diamond compact cutters that is preceded by and guided into a pilot hole by a follower extension that has a jet assisted cutting structure on the forward extremity to remove hole bridges encountered.

SUMMARY OF THE INVENTION

A hole opener for use on a drill string in well bores to follow an existing bore and enlarge the well diameter. Three arrays of poly-crystalline diamond cutting structures are situated on an axial and radial stabilizer form to provide both axial and radial stability by engaging the opener cut face and limit the individual cutter penetration. Channels, or grooves, separate the stabilizer into three individual pads. The grooves allow the opener cuttings to clear the formation and allow upward flow of fluid from the pilot hole below. A pilot hole cutter head on the nose of the pilot hole follower extension removes the occasional bridge encountered. The pilot hole follower extension tapers smaller toward the lower extremity to cause an increase in the velocity of fluid flowing upward from the pilot hole. A jet nozzle in the end of the follower extension assists in clearing cuttings from bridges. Three upwardly directed jet nozzles inbedded in the extension sweep the opener cutting structure and three downwardly directed jet nozzles imbedded in the grooves sweep the exposed opener cut formation. Axially directed elongated barrier blades, one below each groove prevent vortex flow at the confluence of the upwardly and downwardly directed fluid jets. The cutter elements each have a cutting rake angle that rolls the chips upward as cutting proceeds.

DETAILED DESCRIPTION OF DRAWINGS

Figure 1:
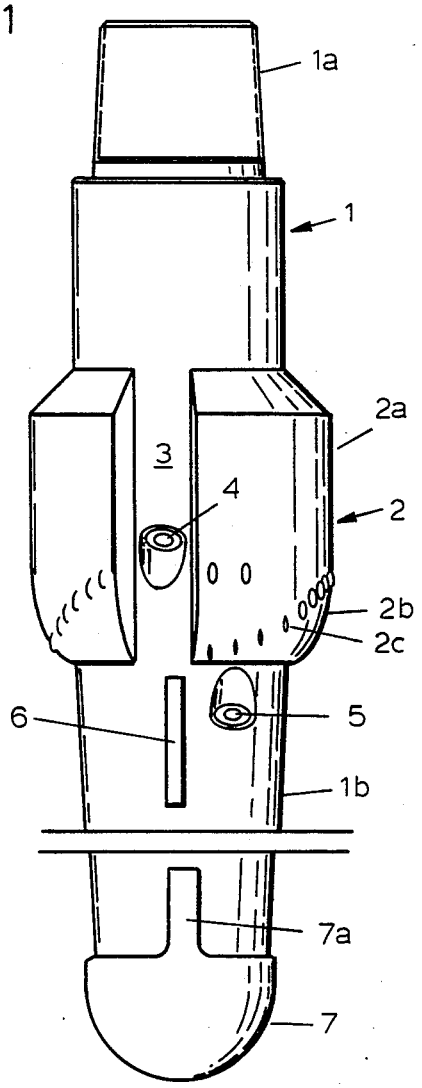
FIG. 1 is a side view of the preferred embodiment of this invention.

In FIG. 1, the body 1 has a top terminal in the form of a pin end of a tool joint 1*a* to attach to a drilling string. Region 2 has the general form of a stabilizer with three pad sections. Region 2*a* is cylindrical on the outer surface and has hard metal inclusions ground on the exposed surface to the cylidrical form. The region 2*b* has a bullet shape or congreve form. The congreve form has poly-crystalline diamond compact insert cutters 2*c*, which extend a generally uniform amount from the basic congreve form to cut formation but to limit the bite into the formation, yet allow a fluid flow clearance between the cut formation and the congreve basic form. Grooves 3 are flow clearances for fluid and cuttings. Jet nozzles 4 are in holes in the wall of the body, situated in the grooves and directed generally downward and outward. The jets of fluid in operation impinge upon and sweep the formation cut by cutters 2*c*.

The body extends below the stablizer in a tapered form 1*b*. Just below the congreve form, jet nozzles 5 are situated in holes in the body and are directed to apply a cleaning jet stream generally upward to spread over the array of cutters 2c. This cleans the cutters and the impulse of the jets provides the drive to urge fluid over the congreve form to propel cuttings into the grooves 3 for continued upward flow. Vortex control blades 6 are situated near the grooves to control the vortex swirl the opposed jets tend to create. The blades 6 are covered at the radially outward edges with tungsten carbide chips in a braze metal covering. The three blades extend radially to approximate the diameter of a pre-drilled well pilot hole. There are three jet nozzles 4, three jet nozzles 5, and three blades 6 distributed about the tool periphery about 120° apart for like features.

The body extension 16 tapers smaller at the lower end to terminate in an approximate hemispherical shape. The hemisphere is set with tungsten carbide chips in a matrix of braze metal 7, and may extend some small amount upward along the taper. There are three radial blades 7a spaced about 120° apart that extend some distance upward along the taper. A jet nozzle (not visible) is situated in the general center of the hemisphere surface and directs a fluid flow downward.

All jets are in holes in the body that connect to a bore in the tool body. The bore in the body receives mud, in service, from an upwardly continuing drill string attached to tool joint 1a.

The application of tungsten carbide chips to the surface of well drilling tools with a braze metal matrix is a common oil field practice. This is done for surfaces that may have to cut, and resist abrasion and possible resist fluid erosion. On surface such as 2a, cutting is not expected and a final grinding is used to smooth the contact surfaces. On surface 2a, however, the tungsten carbide may be formed slugs either pressed into holes or brazed in place.

Figure 2:
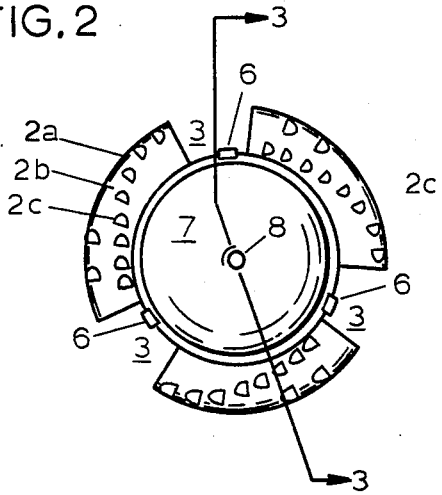
FIG. 2 is a bottom view of the apparatus of FIG. 1.

In FIG. 2, the principal features shown are grooves 3 and stabilizer pads 2. Blades 6 are visible below the grooves.

Figure 3:
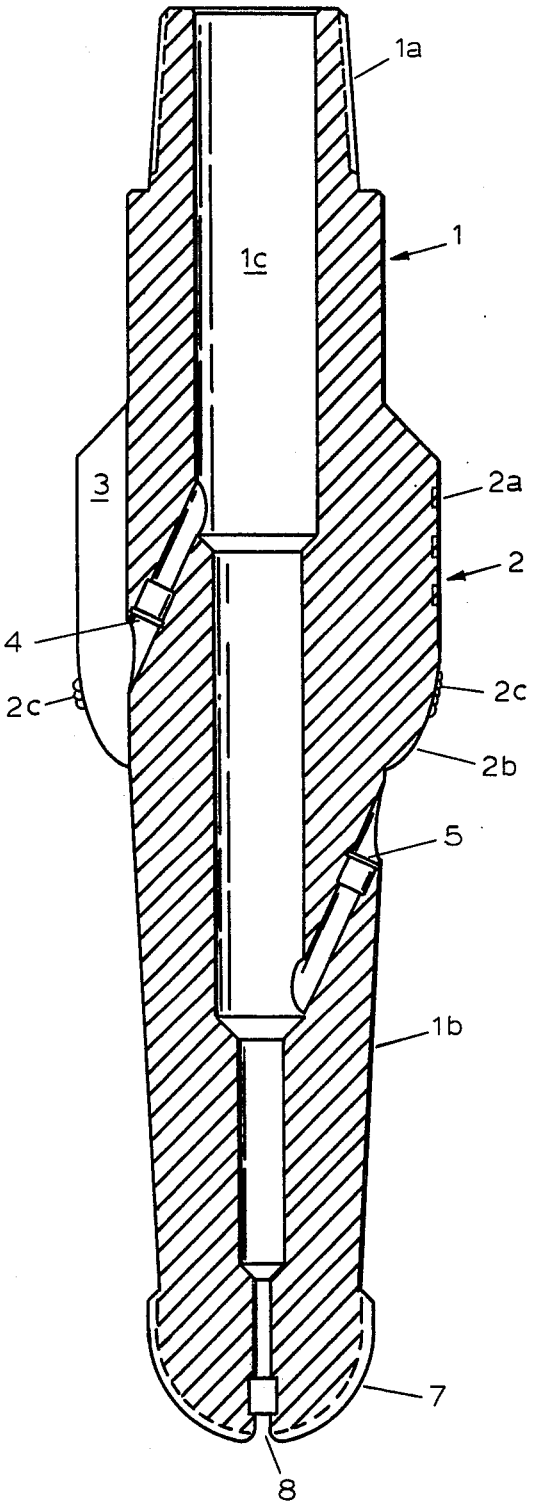
FIG. 3 is a cutaway of the apparatus taken along line 3—3 of FIG. 2, and is somewhat enlarged.

In FIG. 3, the body bore 1c conducts fluid to the jet nozzles. The jet nozzle 8 can now be shown at the lower end of the piloting extension 1b. The cut does not display blades 6 of FIGS. 1 and 2. Some liberty has been taken in showing cutters 2c in the somewhat overlapping pattern, since they would disappear around the congreve if shown correctly. Nozzles 4 and 5 are held in place by lockrings in the traditional manner, but nozzle 8 is brazed in place and can be removed when the metal chips are replaced on the nose in conventional shop rework. Hard metal slugs are shown in the stablizer cylindrical region of pad 2.

Figure 4:
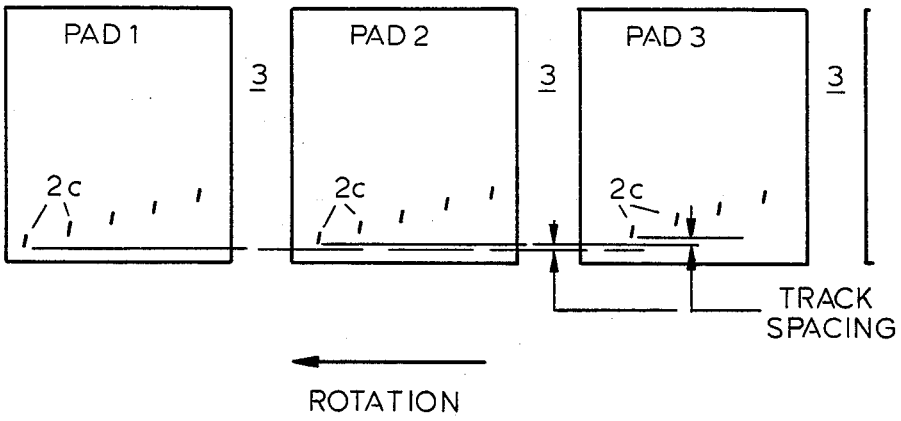
FIG. 4 is a plan view of a development of the surface of a selected area of the apparatus of FIG 1.

FIG. 4 is a development of the stabilizer region of the tool. This is provided to show the staggered relative positions of cutters that operate to cut formation such that the cutters on the different arrays do not perfectly track. For example, the lowest cutter in one array will be slightly lower than the lowest cutter on the next array, and more so than the lowest cutter on the third array. The process is repeated for each higher cutter in the three arrays. As the congreve shape becomes tangent with the cylindrical shape, gage cutters are allowed to track in the interest of finalizing and assuring proper hole gage.

In general, blades 6 may be situated to either lead or lag the jets from nozzles 4, and the choice depends upon the nature of the formation to be cut.

The invention having been described, we claim:

1. A well bore opener usable at the lower end of a drill string conducting a flow of fluid down through the bore, to increase the diameter on an existing pilot hole, apparatus comprising:

(a) an elongated body having an upper end adapted to threadedly engage the lower end of the drill string;

(b) a generally cylindrical region on said body and an extension tapering smaller to a rounded nose on the lower end, and a generally central fluid conducting channel extending from end to end;

(c) a stabilizer comprising a diametral enlargement of said body with an upper generally cylindrical region and a congreve form generally tangential with said cylindrical region and terminating on said body extension, said stabilizer being divided into three stabilizer pads by grooves extending in a generally axial direction;

(d) an array of poly-crystalline diamond compact cutters affixed to said congreve stabilizer region and extending some radial distance from said congreve surface on each pad;

(e) a plurality of jet nozzles situated in holes extending from said body bore through the body wall located at least one in each of said grooves and directed outward and downward from the surface of said groove;

(f) a plurality of jet nozzles situated in holes extending through the wall of said body, at least one directed upward and outward to provide a fluid jet to impinge on each of said congreve form of said stabilizer pads;

(g) a plurality of vortex control blades extending radially outward from said body extension below said grooves, one blade being in general registry with each groove, said blades extending some distance in a generally axial direction relative to said body;

(h) a cutting structure comprising hard metal particles attached to said body extension rounded nose with braze metal; and (i) a generally central jet nozzle terminating said body bore at the surface of said rounded nose.

2. The apparatus of claim 1 further providing that said poly-crystalline cutters be attached to mounting posts, which are in turn pressed into holes drilled in said stabilizer pads.

3. The apparatus of claim 2 further providing that said poly-crystalline cutters be each oriented such that a plane surface exposed for cutting defines a helical line that would, if continued, form a right hand helix about the outer surface of stabilizer pads.

4. The apparatus of claim 1 further providing that said poly-crystalline cutters be set on each pad such that corresponding cutters of other pads do not fall on the same peripheral line extending circumferentially about the apparatus.

5. The apparatus of claim 1 further providing that said cylindrical surface on said stabilizer region be provided with imbedded hard metal particles.

6. The apparatus of claim 1 further providing that said downwardly dircted jets be directed to the leading side, in normal use rotational sense, of said vortex control blades.

7. The apparatus of claim 1 further providing that said downwardly directed jets be directed to the trailing side, in normal use rotational sense, of said vortex control blades.

8. A well bore opener for use as the lower terminal of a drill string, through the bore of which a downward flow of drilling fluid is pumped, to increase the diameter of an existing pilot well bore, apparatus comprising:

(a) an elongated tubular body having an upper and a lower end, said upper end adapted to threadedly engage, with fluid tightness, an upwardly continuing drill string, said lower end having a rounded nose with a nozzle opening terminating an end-to-end fluid channel;

(b) a radial and axial stabilizer situated some distance below said body upper end and comprising; an increased body diameter having for some axial length a generally cylindrical form for radial stabilization on a downwardly continuing shape definable as a bullet shape referred to herein as a congreve form generally tangential to said cylindrical shape and terminating on said body to act as said axial stabilizer, three grooves distributed about the periphery of said body enlargement, aproximately equally spaced and extending in a generally axial direction, said grooves separating said stabilizer into three separate pads;

(c) at least one jet nozzle situated in each of said grooves in fluid communication with said body fluid channel and oriented to direct a jet of fluid against the wall of a well bore cut by said cutters on said congreve form;

(d) at least one jet nozzle for each of said pads, situated in said body in communication with said fluid channel oriented to direct a jet of fluid against said congreve surface on said pad;

(e) a hard metal cutting structure surface on said rounded lower end of said body; and (f) an elongated vortex barrier blade for each of said grooves situated on said body below each groove, extending some radial distance from said body, said elongation extending in a generally axial direction on said body.

9. The apparatus of claim 8 further providing imbedded hard metal elements generally flush with said cylindrical surfaces on said stabilizer pads.

10. The apparatus of claim 8 further providing that each of said poly-crystalline compact cutter elements be attached to support studs which, in turn, are pressed into holes in said congreve shaped region of said stabilizer pads.

11. The apparatus of claim 8 further providing that the outer surface of said body, below said stabilizer, be tapered in a generally conical form, the diameter being reduced toward said rounded lower end of said body.

* * * * *